US008607476B2

(12) United States Patent
Jessiman et al.

(10) Patent No.: US 8,607,476 B2
(45) **Date of Patent: *Dec. 17, 2013**

(54) WATERPROOF BREATHABLE FOOTWEAR HAVING HYBRID UPPER CONSTRUCTION

(75) Inventors: Alexander W. Jessiman, Kennett Square, PA (US); Robert J. Wiener, Middletown, DE (US)

(73) Assignee: W. L. Gore & Associates, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/613,181

(22) Filed: Sep. 13, 2012

(65) Prior Publication Data

US 2013/0047473 A1 Feb. 28, 2013

Related U.S. Application Data

(62) Division of application No. 12/569,238, filed on Sep. 29, 2009, now Pat. No. 8,296,970.

(51) Int. Cl.
*A43B 7/06* (2006.01)

(52) U.S. Cl.
USPC ..... 36/45; 36/3 R; 36/3 A

(58) Field of Classification Search
USPC ..... 36/3 R, 3 A, 45, 55
See application file for complete search history.

(56) References Cited

U.S. PATENT DOCUMENTS

| | | | | |
|---|---|---|---|---|
| 1,413,508 | A | 4/1922 | Von Arnhem | |
| 2,306,306 | A | 12/1942 | Conrad | |
| 3,953,566 | A | 4/1976 | Gore | |
| 4,599,810 | A | 7/1986 | Sacre | |
| 4,918,981 | A | 4/1990 | Gore | |
| 5,814,405 | A | 9/1998 | Branca et al. | |
| 6,065,227 | A | 5/2000 | Chen | |
| 6,260,288 | B1 | 7/2001 | Barthelemy et al. | |
| 6,541,589 | B1 | 4/2003 | Baillie | |
| 6,935,053 | B2 | 8/2005 | Wiener | |
| 6,986,183 | B2 | 1/2006 | Delgorgue et al. | |
| 7,306,729 | B2 | 12/2007 | Bacino et al. | |
| 8,296,970 | B2 * | 10/2012 | Jessiman et al. | 36/45 |
| 2002/0078593 | A1 | 6/2002 | Pavelescu et al. | |
| 2002/0078599 | A1 | 6/2002 | Delgorgue et al. | |
| 2003/0145485 | A1 | 8/2003 | Chen | |
| 2003/0200679 | A1 | 10/2003 | Wilson et al. | |
| 2005/0028405 | A1 | 2/2005 | Wilson et al. | |
| 2006/0117608 | A1 | 6/2006 | Chen | |
| 2007/0245595 | A1 | 10/2007 | Chen et al. | |
| 2008/0016717 | A1 | 1/2008 | Ruban | |

FOREIGN PATENT DOCUMENTS

| | | |
|---|---|---|
| EP | 1 034 713 | 9/2000 |
| EP | 1 173 327 | 6/2003 |
| JP | 5 9072905 | 5/1984 |

* cited by examiner

*Primary Examiner* — Marie Patterson
(74) *Attorney, Agent, or Firm* — Carol A. Lewis White

(57) ABSTRACT

An article of footwear that exhibits enhanced whole boot breathability and reduced wet pickup is provided. The footwear article includes an upper having an inferior and superior compartment; a mechanism for joining the superior and inferior compartments together; a protective cover; and an outer sole.

1 Claim, 2 Drawing Sheets

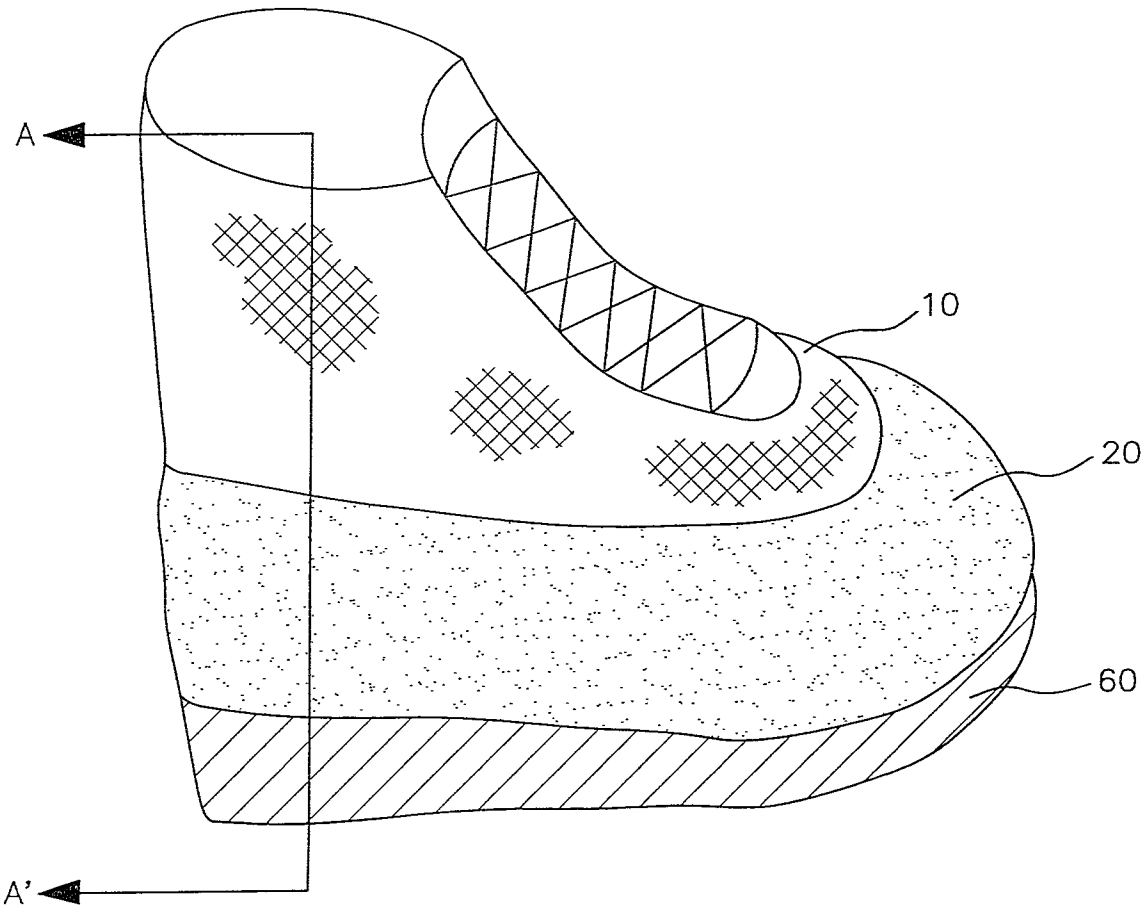
FIG. 1
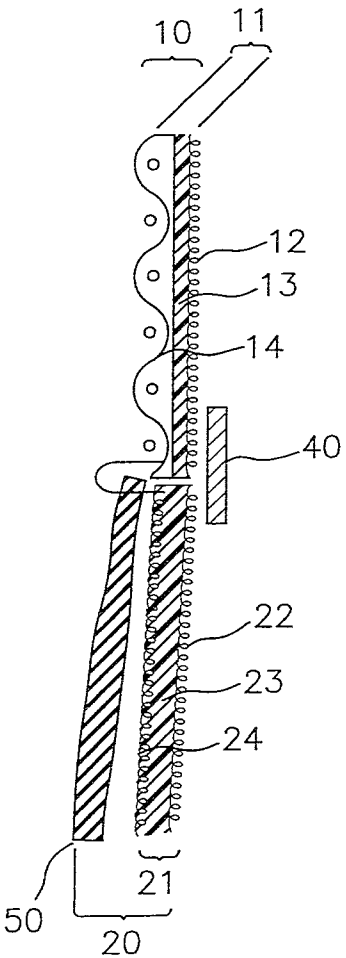

WATERPROOF BREATHABLE FOOTWEAR HAVING HYBRID UPPER CONSTRUCTION

RELATED APPLICATION

The present application is a divisional application of allowed U.S. patent application Ser. No. 12/569,238 filed Sep. 29, 2009 now U.S. Pat. No. 8,296,970.

BACKGROUND

Numerous attempts have been made at achieving waterproof, breathable footwear. Early attempts for making such footwear included the making of footwear having upper materials (i.e. leather) that were treated to make the upper water resistant as well as soles made of rubber. Several problems, however, arose with this type of footwear construction. The upper material would lose its breathability when it was treated to impart water resistance, thus making the footwear uncomfortable for the wearer. Further, the connecting region between the waterproof sole and the upper became a major source of leakage as there was no known effective way to make the connecting region waterproof.

An alternative approach to the goal of achieving comfortable waterproof footwear involved employing a waterproof insert or bootie into the shoe. This waterproof insert, if constructed of appropriate materials had the additional advantage of being permeable to water vapor so that there was limited buildup of water vapor within the shoe over the time when the shoe was being worn. In the footwear art materials which are both waterproof and water vapor permeable are commonly referred to as "functional" materials. Exemplary of such a functional material is a microporous, expanded polytetrafluoroethylene membrane material available from W. L. Gore and Associates, Inc., Elkton, Md., under the trade name GORE-TEX® Other functional materials have also been developed and are well known in the art.

Further approaches have included securing, by a lasting process, a waterproof, breathable liner material to the inside of the footwear upper and sealing the liner material to a waterproof gasket or insole. There have been many different attempts at providing a durable, waterproof seal or connection at the region where the liner material is joined with the waterproof gasket or insole. These attempts have resulted in varying degrees of success.

One problem which often results when forming such waterproof, breathable footwear is that the insertion of the liner or bootie will often result in a poor fitting shoe (i.e., a smaller fit due to the liner being inserted into the already sized shoe upper) and/or poor attachment between the liner or bootie and the shoe upper material, which results in, among other things, a less than desirable appearance of the inside of the footwear (i.e., the liner appears wrinkled or pulls away from the upper).

A further problem which may result is that during use in wet conditions, water may become trapped between the outer layer of the bootie and the upper resulting in a perceivable weight increase of the footwear. This could result in discomfort for the wearer, especially in cold weather when the wet footwear could result in conductive heat loss.

Thus, there remains a need for footwear that is both lightweight and maintains a high degree of durability and breathability.

SUMMARY OF INVENTION

Waterproof breathable footwear having a hybrid upper construction is described. The hybrid construction provides for a waterproof, breathable footwear article having an upper which includes a superior compartment 10 and an inferior compartment 20. The superior compartment of the upper may include a laminate 11 having an innermost layer 12, at least one middle layer 13, and an outermost layer 14. The inferior compartment may include a laminate 21 having an innermost layer 22, at least one middle layer 23, and an outermost layer 24. The outermost layer of said superior compartment may be composed of a different material the outermost layer of the inferior compartment. The footwear article may further includes a connecting means 40 for connecting the inferior compartment to the superior compartment, a breathable protective cover 50 for covering said outermost layer of the inferior compartment; and an outer sole 60 in communication with said upper.

In an embodiment, the connecting means is in communication with the innermost layer of the superior compartment and the innermost layer of the inferior compartment. Although the connecting means may be in contact with the outer and middle layers of the superior and/or inferior compartments, in some embodiments the connecting may not be in contact with the outer layer of the superior and/or inferior compartment. The connecting means may be a tape, sealant, stitch, the like, or combinations thereof. Alternatively, the connecting means may be an ultrasonic bond, a seam seal, a heat bond, the like, or combinations thereof. Further, the outer sole may be joined to said upper by a gasket, injection mold, cement, tape or the like.

In an embodiment, the innermost layer of the superior compartment laminate may compose a woven, knit, or nonwoven textile. The at least one middle layer of the superior compartment laminate comprises at least one film. Desirably, the film may be a microporous polymer, desirably a microporous polytetrafluoroethylene. Alternatively, the film may be a fluoropolymer, a polyurethane, a polyester, or combinations thereof. The outermost layer of the superior compartment may be a woven fabric, knit fabric, a nonwoven fabric, leather, synthetic leather, perforated rubber, polymer mesh, a discontinuous pattern of non-breathable material, the like, or combinations thereof.

In an additional embodiment, the innermost layer of the inferior compartment may be a woven, knit, or nonwoven textile. The at least one middle layer of the inferior compartment laminate comprises at least one film. Desirably, the film may be a microporous polymer, desirably a microporous polytetrafluoroethylene. Alternatively, the film may be a fluoropolymer, a polyurethane, a polyester, or combinations thereof. The outermost layer of the inferior compartment may be a woven fabric, knit fabric, a nonwoven fabric, leather, synthetic leather, perforated rubber, polymer mesh, a discontinuous pattern of non-breathable material, the like, or combinations thereof. A protective cover, desirably leather, is also included within the inferior compartment In an embodiment, the outermost layer of the superior compartment is more abrasion resistant than the protective layer of the inferior compartment, and the outermost layer of the superior compartment is more abrasion resistant than the outermost layer of the inferior compartment. Importantly, and in contrast to the prior art, this allows for greater breathability in the inferior compartment where breathability is most needed for user comfort. Further, this construction allows for greater abrasion resistance and less breathability in the superior compartment where the outermost layer of the superior compartment is exposed. Further, this streamlined construction offers advantages over prior art bootie constructions because it is more lightweight (uses less materials) and is less likely to pick up extra water weight because there are less layers of material for water to become trapped between. In this regard, in an embodiment, the current inventive hybrid construction comprises two three-layer laminates in superior/inferior positional relation to each other wherein the outermost layer of the superior compartment is an outermost layer of the upper while prior art footwear constructions, in many cases, include an upper (which may comprise a laminate) and an additional bootie in a lateral positional relationship.

Further, to this end, in an embodiment of the invention, the laminate of the superior compartment has a moisture vapor transmission rate greater than 1100 $g/m^2/24$ hours and the laminate of the inferior compartment has a moisture vapor transmission rate greater than 2200 $g/m^2/24$ hours. Additionally, the whole boot moisture vapor transmission rate is 8.75 g/hr or greater, more desirably 10 g/hr or greater, even more desirably 12 g/hr or greater. Further, with regard to abrasion resistance, the laminate of the superior compartment remains in tact up to about 1500 cycles, more desirably 2500 cycles on the Abrasion Resistance test, and laminate of the inferior compartment remains in tact up to about 250 cycles, more desirably 400 cycles on the Abrasion Resistance Test. With regard to the wet pickup test, the footwear article picks up less than 40 grams of water when subjected to the wet pick up test, desirably less than 30 grams of water, and more desirably less than 20 grams of water.

Another aspect of the invention addresses waterproof breathable footwear having an upper which includes a superior compartment 10 and an inferior compartment 20. The superior compartment of the upper may include a laminate 11 having an innermost layer 12, at least one middle layer 13, and an outermost layer 14. The inferior compartment may include a laminate 21 having an innermost layer 22, at least one middle layer 23, and an outermost layer 24. The outermost layer of said superior compartment may be composed of a different material the outermost layer of the inferior compartment. The footwear article may further include a tape, sealant, stitch, ultrasonic bond, a seam seal, a heat bond or the like for connecting the inferior compartment to the superior compartment, a breathable protective cover 50 for covering said outermost layer of the inferior compartment; and an outer sole 60 in communication with said upper.

BRIEF DESCRIPTION OF DRAWINGS

FIG. 1 is a perspective and cross-sectional view of a waterproof, breathable, footwear article having a hybrid construction of inferior and superior compartments.

DEFINITIONS

Figure 2:
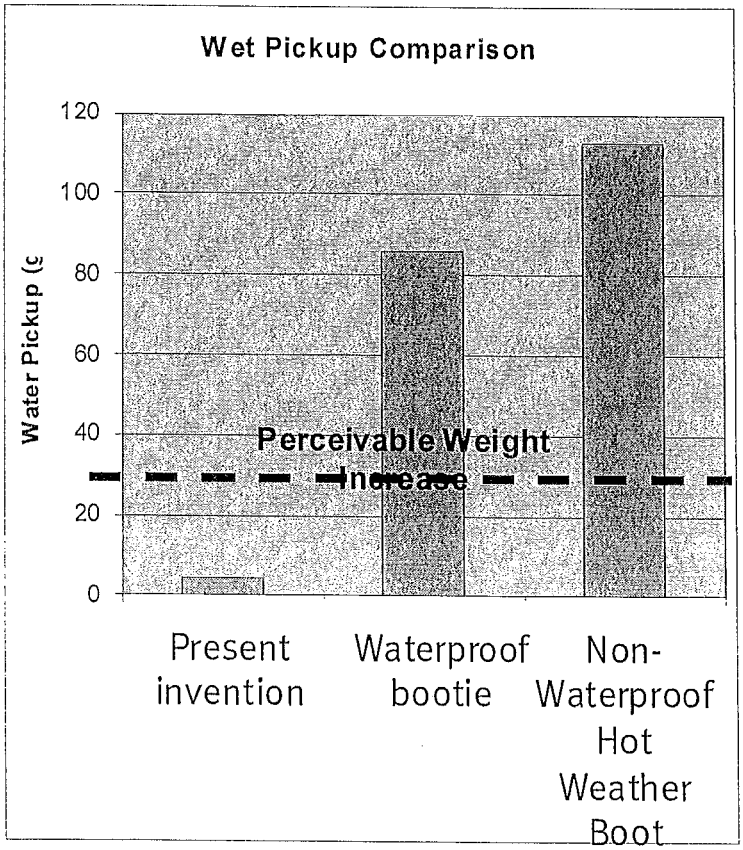
FIG. 2 illustrates the superior wet pickup value of the inventive hybrid construction.

Waterproof footwear—The footwear is placed on top of a piece of blotter paper. The inside of the footwear is filled with room temperature water to a height of about 30 mm (measured from the insole at the heel area of the footwear). The water is allowed to stand in the footwear for at least two hours. At the end of the two hour period the blotter paper and footwear upper are examined to determine if water has reached the blotter paper or the outside of the upper. If no water has reached the blotter paper or the outside of the upper, then the footwear is waterproof.

DETAILED DESCRIPTION

The present invention provides for a breathable, waterproof article of footwear having a superior and inferior compartment. The footwear articles are relatively light weight and are less prone to water pickup than traditional bootie style footwear.

The invention will be described with reference to the following description and figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and embodiments.

Turning to FIG. 1, a waterproof breathable footwear article is provided. The footwear includes an upper comprising a superior compartment 10 and inferior compartment 20. The superior compartment includes a laminate 11 which is composed of an innermost layer 12 (closest to foot), at least one middle layer 13, and an outermost layer 14 (furthest from foot and directly exposed to outside environment during use).

The innermost layer of the superior compartment is desirably made from a lightweight material that provides comfort and breathability to the user when the user's foot comes into contact with the innermost layer during normal use and wear of the article of footwear. This materials may include, but is not limited to, a nonwoven fabric, knit fabric, or woven fabric such as, for example cotton rayon, nylon, polyester, the like, or combinations thereof.

Desirably, the at least one middle layer of the superior compartment comprises a film. Desirably, the film may include polymeric materials such as fluoropolymers, polyolefins, polyurethanes, and polyesters. Suitable polymers may comprise resins that can be processed to form porous or microporous membrane structures. For example, polytetrafluoroethylene (PTFE) resins that can be processed to form stretched porous structures are suitable for use herein. For example, PTFE resins can be stretched to form microporous membrane structures characterized by nodes interconnected by fibrils when expanded according to the process taught in patents such as in U.S. Pat. Nos. 3,953,566, 5,814,405, or 7,306,729. In some embodiments, expanded PTFE fluoropolymer films are made from PTFE resins according to U.S. Pat. No. 6,541,589, having comonomer units of polyfluorobutylethylene (PFBE). For example, microporous expanded PTFE (ePTFE) fluoropolymers can comprise PTFE having from about 0.05% by weight to about 0.5% by weight of comonomer units of PFBE based upon the total polymer weight.

In one embodiment, the film includes ePTFE having a microstructure characterized by nodes interconnected by fibrils, wherein the pores of the porous film are sufficiently tight so as to provide liquidproofness and sufficiently open to provide properties such as moisture vapor transmission, and penetration by coatings of colorants and oleophobic compositions. For example, in some embodiments, it is desirable for the porous membranes to have an average median flow pore size of less than or equal to about 400 nm to provide water resistance, and a median flow pore size greater than about 50 nm for colorization. This may be accomplished by compounding a PTFE resin which is suited to produce a node and fibril microstructure upon stretching. The resin can be blended with an aliphatic hydrocarbon lubricant extrusion aid such as a mineral spirit. The compounded resin may be formed into a cylindrical pellet and paste extruded by known procedures into a desired extrudable shape, preferably a tape or membrane. The article can be calendared to the desired thickness between rolls and then thermally dried to remove the lubricant. The dried article is expanded by stretching in the machine and/or transverse directions, for example, according to the teachings of U.S. Pat. Nos. 3,953,566, 5,814,405, or 7,306,729, to produce an expanded PTFE structure characterized by a series of nodes which are interconnected by fibrils. The ePTFE article is then amorphously locked by heating the article above the crystalline melt point of PTFE, for example between about 343°-375° C.

The outermost layer 14 of the superior compartment may include a woven fabric, a nonwoven fabric, leather, synthetic leather, perforated rubber, polymer mesh, a discontinuous pattern of non-breathable material, the like, or combinations thereof. Regardless of the type of material utilized for the outermost layer of the superior compartment it should impart sufficient abrasion resistance to the laminate to provide adequate protection for the wearer of the article of footwear. Suitable abrasion resistance of the laminates, in accordance with ASTM D3886 includes laminates which remain intact up to about 1000 cycles, more desirably 1500 cycles, and even more desirably 2500 cycles. The laminate of the superior compartment should have a moisture vapor transmission rate of desirably greater than 1100 $g/m^2/24$ hours.

As known in the art, the layers of the laminate may be joined together utilizing a variety of methods. One such method includes utilizing adhesives. The adhering to form the laminate can be effected either with adhesive which has been applied in continuous form, i.e., over the whole area, or with adhesive which has been applied discontinuously, i.e. with gaps. Water-vapor-permeable adhesive is used in the case of a continuous adhesive layer being applied. For the use of a discontinuous adhesive layer, for example applied in powder, dot, net or matrix form, it is possible to use an adhesive which is not inherently water-vapor-permeable. Powdered adhesive may be desirable due to its low cost and the ease of adjusting adhesive laydowns. In this case, water vapor permeability is maintained by only a fraction of the surface of the layer being covered with adhesive.

The adhesive layer can be a layer of thermo-activatable adhesive. If this thermo-activatable adhesive is used for manufacturing a laminate from which footwear is manufactured the activation of the laminating adhesive can be affected by a heating device either applied from the inside or from the outside of the shoe.

Alternatively, the individual layers of the superior compartment may be laminated together utilizing ultrasonic bond, a seam seal, a heat bond, or the like as known in the art.

Returning to FIG. 1, the waterproof breathable footwear article also includes an inferior compartment. The inferior compartment includes a laminate 21 which is composed of an innermost layer 22, at least one middle layer 23, and an outermost layer 24.

Like the superior compartment, the inferior compartment's innermost layer is desirably made from a lightweight material that provides comfort and breathability to the user when the user's foot comes into contact with the innermost layer during normal use and wear of the article of footwear. This materials may include, but is not limited to, a nonwoven fabric, knit fabric, or woven fabric such as, for example cotton rayon, nylon, polyester, the like, or combinations thereof.

Further, like the superior compartment, the inferior compartment laminate includes at least one middle layer composed of at least one film. The film of the inferior compartment utilizes the same materials described above for the superior compartment Additionally, like the superior compartment, the inferior compartment comprises an outer layer. Although the outer layer may include any of the materials described above for use in the outer layer of the superior compartment, the specific component or components used in the outer layer should be selected to impart less abrasion resistance to the inferior compartment laminate as compared to the superior compartment laminate, In this regard, Suitable abrasion resistance of the inferior compartment laminates, in accordance with ASTM D3886 includes laminates which remain intact up to about 200 cycles, more desirably 400 cycles, The laminate of the inferior compartment should have a moisture vapor transmission rate of desirably greater than 2200 $g/m^2/24$ hours Further, as described above for the superior compartment, the layers of the laminate of the inferior compartment may be joined together utilizing a variety of methods as known in the art.

The inferior compartment also includes a protective cover 50 for the inferior compartment laminate. The protective cover may be constructed of a variety of materials including, but not limited to, leather, woven fabrics, knit fabrics, synthetic leather, perforated rubber, polymer mesh, a discontinuous pattern of non-breathable material, nonwoven fabrics, the like, or combinations thereof. Regardless of the type of material used for the protective cover, it should be of sufficient durability to protect the inferior compartment laminate during normal use of the footwear article and breathable enough to maintain comfort within the shoe.

Returning to FIG. 1, a connecting means is utilized for connecting the inferior compartment to the superior compartment. The connecting means may be any suitable method known in the art. For example, a tape, sealant, stitch, the like, or combinations thereof. Alternatively, the connecting means may be an ultrasonic bond, a seam seal, a heat bond, the like, or combinations thereof.

The waterproof breathable footwear article also includes an outer sole. The outer sole may be joined to the upper by any suitable methods known in the art that does not adversely affect the waterproofness of the footwear. These methods include, but are not limited to, utilization of a gasket, injection mold, cement, or the like.

Test Methods

Moisture Vapor Transmission Rate Test (MVTR)

The moisture vapor transmission rate for each sample was determined in accordance with ISO 15496 except that the sample water vapor transmission (WVP) was converted into MVTR moisture vapor transmission rate (MVTR) based on the apparatus water vapor transmission (WVPapp) and using the following conversion.

$$MVTR=(\text{Delta } P \text{ value}*24)/((1/WVP)+(1+WVPapp \text{ value})))$$

Additionally, the standard specifies a cup diameter of between 85 and 95 mm, but a 64 mm cup diameter was used. Further, sodium chloride was substituted for potassium acetate.

Abrasion Resistance Test

Abrasion resistance was measured using ASTM D3886, Standard Test Method for Abrasion Resistance of Textile Fabrics with the following exceptions. No electrical contact was used. Norton P320J abrasion paper was used instead of 0 Emery.

Whole Boot Moisture Vapor Transmission Rate Test

The Whole Boot Moisture Vapor Transmission Rate for each sample was determined in accordance with Department of Defense Army Combat Boot Temperate Weather Specifications. The specifications are as follows:

4.5.4 Whole boot breathability. The boot breathability test shall be designed to indicate the Moisture Vapor Transmission Rate (MVTR) through the boot by means of a difference in concentration of moisture vapor between the interior and the exterior environment.

4.5.4.1 Apparatus.

a. The external test environment control system shall be capable of maintaining 23 (±1) C and 50%±2% relative humidity throughout the test duration.

b. The weight scale shall be capable of determining weight of boots filled with water to an accuracy of (±0.01) gram.

c. The water holding bag shall be flexible so that it can be inserted into the boot and conform to the interior contours; it must be thin enough so that folds do not create air gaps; it must have much higher MVTR than the footwear product to be tested; and it must be waterproof so that only moisture vapor contacts the interior of the footwear product rather than liquid water.

d. The internal heater for the boot shall be capable of controlling the temperature of the liquid water uniformly in the boot to 35 (±1) C.

e. The boot plug shall be impervious to both liquid water and water vapor.

4.5.4.2 Procedure.

a. Place boot in test environment.

b. Insert holding bag into boot opening and fill with water to a height of 12.5 cm (5 in) measured from inside sole.

c. Insert water heater and seal opening with boot plug.

d. Heat water in boot to 35 C.

e. Weigh boot sample and record as Wi.

f. Hold temperature in boot after weighing for a minimum of 6 hours.

g. After 6 hours, reweigh boot sample. Record weight as Wf and test duration as Td.

h. Compute whole boot MVTR in grams/hour from the equation below:

$$MVTR=(Wi-Wf)/Td$$

4.5.4.3 Method of Inspection. Each boot shall be tested in accordance with the method described in paragraph 4.5.4.2. The average whole boot MVTR from the 5 boots tested shall be greater than 3.5 grams/hour to satisfy the breathability standard.

Wet Pickup Test

Wet pickup of boots were determined as follows. Men's size 9 boots were used, and weights of each of the left and right boots were recorded. Subjects than walked in a custom-built trough, 30 feet in length, 48 inches wide with plexiglass walls of 12". Room temperature water was filled to a 2" depth throughout the trough. A subject walked in the trough for 30 minutes and then walked on a rubber mat outside the trough (30 feet in length) for 15 minutes.

The boots were then weighed. Wet pickup was defined as the difference between pre weight and post weight of boots after walking through the trough.

Example 1

A boot was made with an upper laminate material comprising an inferior compartment and a superior compartment. The laminate of the superior compartment is a three layer laminate having a) 8.8 oz. 1000D nylon weave b) expanded polytetrafluoroethylene membrane c) 6 oz hydrophilic nylon, texturized polyester knit, d) hot melt adhesive to hold the fabric together, available from Gore and Associates, Elkton, Md., Part Number EXQD102120AZ EXQD102120AZ. The laminate of the inferior compartment is a three layer laminate having: a) 1.5 oz. nylon tricot knit b) expanded polytetrafluoroethylene membrane c) 6 oz hydrophilic nylon, texturized polyester knit, d) hot melt adhesive to hold the fabric together, available from Gore and Associates, Elkton, Md., Part Number EAAM120108AZ: EAAM120108AZ.

The laminates of both the superior compartment and inferior compartment were tested utilizing the MVTR test method described above. The laminate of the superior compartment had a MVTR of 1600 g/m$^2$/24 hours and the laminate of the inferior compartment had an MVTR of 3200 g/m$^2$/24 hours.

The laminates of both the superior compartment and inferior compartment were also tested for abrasion resistance utilizing the Abrasion Resistance Test described above. The inferior compartment laminate exhibited wear through at 350-400 cycles and the superior compartment laminate exhibited wear through at 2400 to 2550 cycles.

In preparing the footwear article of the present invention the laminates of the superior compartment were joined together, along with a protective leather cover of the inferior compartment laminate, to form the upper of the boot. The superior compartment and inferior compartment were stitch seamed and joined together utilizing thermoplastic adhesive tape (Gore Seam™ tape, available from Gore and Associates, Elkton, Md.) in order to ensure waterproofness in the upper.

An insole board was attached to a last by staples. The upper laminate was wrapped around the last and the upper was pulled over the toe region. Using a lasting machine, the toe region was then attached to the insole board using a hot melt adhesive that was applied automatically by the lasting machine, A second lasting machine was then used to complete the lasting of the side and heel areas of the footwear article. A polyurethane polymer resin was then applied to the lasting margin.

The boot was then pressed into a hot mold which included a hot plate and a shaped silicone rubber mold, The shape of the silicone rubber mold matched that of the boot bottom. The hot plate was heated to 157 C which resulted in temperature distribution on the surface of the silicone rubber mold from 70 to 100 C. A piece of release paper was placed on the bottom of the hot mold and the boot was placed into a sole press. The hydraulic system of the sole press was set at 40 kg/cm$^2$. The sole press was actuated, thus pressing the boot into the hot mold, for 60 seconds. The boot was then removed from the mold, and the release paper was removed from the bottom of the boot. A gasket in the shape of the bottom of the boot was heated in a flash activator then placed on the bottom of the boot. The boot was then placed back into the hot mold and the sole press actuated for 60 seconds. A prepared sole and the gasketed boot where then heated in a flash activator, as is standard in the art. The sole was placed on the bottom of the boot then pressed onto the boot in the sole press. The sole press was configured in a standard setup used for sole attachment. The hydraulic system of the sole press was set at 10 kg/cm$^2$ and was actuated for 15 seconds. The boot was allowed to cool and the last was removed from the boot.

The boot was then test for waterproofness according to the test for waterproofness described above. The boot passed the test.

Example 2

A standard 8 inch boot manufactured in accordance with the present invention was subjected to the Wet-Pickup Test described above. Additionally, both a waterproof (trade name Belleville 790 available from Belleville Shoe Manufacturing Company, Belleville, Ill.) utilizing a standard bootie construction and non-waterproof (trade name Belleville DST105R available from Belleville Shoe Manufacturing Company, Belleville, Ill.) 8 inch boot were tested. The results are shown in FIG. 2.

As demonstrated in FIG. 2, the boots manufactured in accordance with the present invention picked up substantially less water than the boot manufactured with a waterproof bootie and the non-waterproof hot weather boot.

Example 3

Four sets of five (20 total) standard eight inch boots manufactured in accordance with the present invention were subjected to the whole boot moisture vi Delete ion test described above. Additionally, four sets of five (20 total) standard eight inch waterproof boots manufactured with a standard bootie construction (trade name Belleville 790 available from Belleville Shoe Manufacturing Company, Belleville, Ill.) were tested. Further, an additional four sets of five (20 total) standard eight inch waterproof boots manufactured with a standard bootie construction (trade name Bates ICB available form Wolverine Worldwide, Inc., Rockford, Mich.). The average of each of the sets was measured. The Results are listed below.

| BOOT | WBMVTR Range (g/h) |
|---|---|
| Inventive Boot | 8.9-12.6 |
| Belleville790 | 4.0-8.5 |
| Bates ICB | 4.0-8.5 |

As demonstrated in the above table, the boots manufactured in accordance with the present invention had average whole boot moisture vapor transmission test results higher than boots manufactured with the standard waterproof bootie construction.

The invention claimed is:

1. A waterproof, breathable footwear article comprising:

An upper comprising a superior compartment and an inferior compartment, wherein said superior compartment comprises a laminate comprising an innermost layer, at least one middle layer, and an outermost layer, and further wherein said inferior compartment comprises a laminate comprising an innermost layer, at least one middle layer, and an outermost layer, wherein said outermost layer of said superior compartment comprises a different material than said outermost layer of said inferior compartment;

a tape, sealant, stitch, ultrasonic bond, a seam seal, a heat bond or the like for joining said inferior compartment to said superior compartment;

a breathable protective cover for covering said outermost layer of said laminate of said inferior compartment; and an outer sole in communication with said upper, wherein the tape, sealant, stitch, ultrasonic bond, a seam seal, a heat bond or the like is in connection with the innermost layer of the inferior or superior compartment, and wherein the tape, sealant, stitch, ultrasonic bond, a seam seal, a heat bond or the like is in connection with the outermost layer of the inferior or superior compartment.

* * * * *

UNITED STATES PATENT AND TRADEMARK OFFICE

CERTIFICATE OF CORRECTION

PATENT NO. : 8,607,476 B2
APPLICATION NO. : 13/613181
DATED : December 17, 2013
INVENTOR(S) : Alexander Jessiman and Robert Wiener It is certified that error appears in the above-identified patent and that said Letters Patent is hereby corrected as shown below:

In the Specification

Column 9, line 13: change “vi Delete ion” to --vapor transmission--.

Column 9, line 20: change “form” to --from--.

Signed and Sealed this
Thirteenth Day of May, 2014

Michelle K. Lee

Michelle K. Lee
*Deputy Director of the United States Patent and Trademark Office*